United States Patent [19]

Giardino et al.

[11] Patent Number: 4,497,197

[45] Date of Patent: Feb. 5, 1985

[54] PNEUMATIC HYDRAULIC HAND-HELD POWER UNIT

[75] Inventors: David A. Giardino, Deerfield; Joseph R. Groshans; Kenneth A. McHenry, both of Clinton, all of N.Y.

[73] Assignee: Chicago Pneumatic Tool Company, New York, N.Y.

[21] Appl. No.: 467,652

[22] Filed: Feb. 18, 1983

[51] Int. Cl.[3] ..... B21J 15/34

[52] U.S. Cl. ..... 72/453.17; 92/111; 92/85 R; 72/391

[58] Field of Search ..... 60/477, 478, 479; 92/85 R, 111; 72/391, 453.17

[56] References Cited

U.S. PATENT DOCUMENTS

| | | | |
|---|---|---|---|
| 1,940,304 | 12/1933 | Jackson | 72/453.17 |
| 2,329,709 | 9/1943 | Fischer | 72/453.17 |
| 4,118,969 | 10/1978 | Corbett | 72/453.17 X |
| 4,259,858 | 4/1981 | Freeman et al. | 72/453.17 |

*Primary Examiner*—W. D. Bray

*Attorney, Agent, or Firm*—Stephen J. Rudy

[57] ABSTRACT

A pneumatic hydraulic hand-held riveting tool having a pneumatic operative means arranged to generate pressure upon a hydraulic fluid whereby a rivet set plunger is brought into contact with a rivet to be set without deformation of the rivet, and being further arranged to generate hydraulic pressure on the rivet set plunger effective to set the rivet, as well as to provide rapid hydraulic pressure relief.

7 Claims, 14 Drawing Figures

FIG. 7
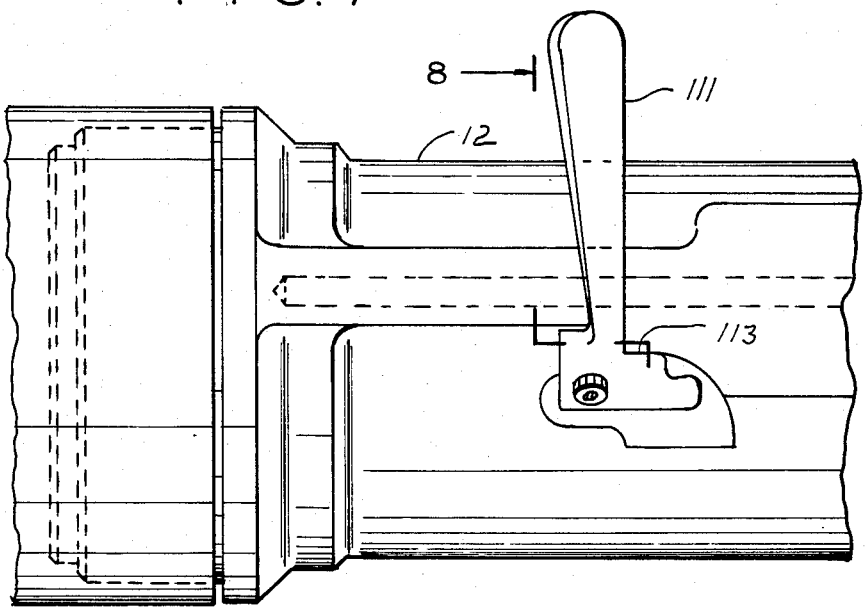
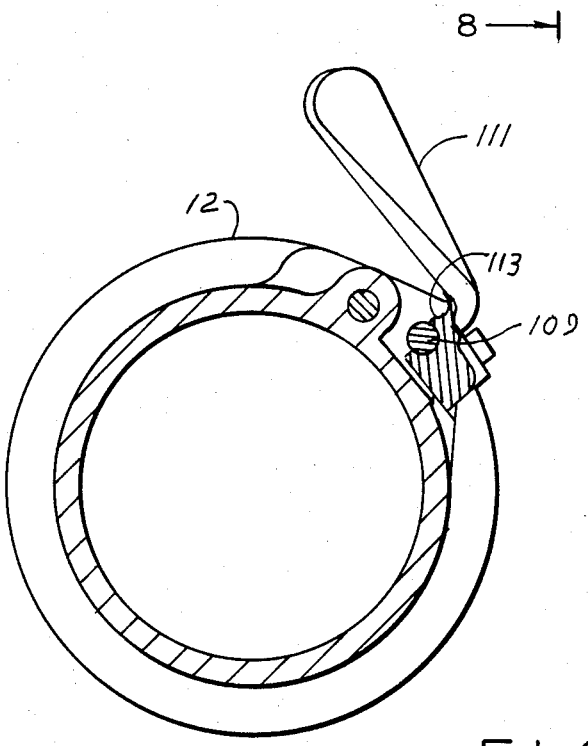
FIG. 8

PNEUMATIC HYDRAULIC HAND-HELD POWER UNIT

BACKGROUND OF INVENTION

This invention relates to a hand held pneumatic hydraulic power unit that may be used for setting rivets, shearing, forming, punching, etc.; this disclosure relating to its use as a riveting tool.

While hand held riveting tools are well known, the tool of the subject invention incorporates certain features which provide advantages over known tools of the prior art.

More particularly, the tool of the subject invention eliminates the need for a separate hydraulic power unit for delivery of pressurized hydraulic medium to the tool, thus, among other things, avoiding loss of power in fluid conducting hoses associated with such an arrangement.

The tool of the subject invention can be of lighter weight than a pneumatic hand held riveting tool of the same maximum force riveting capacity.

Another feature of the tool of the present invention is a throttle valve arrangement wherein the rivet setting piston can be moved to rivet contact position before full riveting pressure is applied, thus, allowing accurate contact rivet alignment prior to a rivet squeezing operation.

Another feature of the tool of the present invention is that movement of the throttle valve to the non-operative position during any part of the power stroke or in the stall condition results in rapid movement of the piston in the hydraulic cylinder away from the rivet setting position.

The tool of the present invention can be provided either with a "C" type riveting yoke, or an alligator type riveting yoke, the latter being arranged to provide the same output force regardless of reach, such being accomplished by a different mechanical advantage in each size. In pneumatic type riveters using a wedge and roller arrangement in an alligator type yoke, the riveting pressure decreases as the reach (length) increases.

A further feature of the tool of the present invention is a throttle lever safety arrangement whereby the throttle lever must be pushed forward before it is in tool operative condition.

Still another feature is that full tool pressure can be applied at all times to the rivet throughout the entire rivet setting operation until power cutoff.

These and further features and advantages of the invention will become apparent from the following description and accompanying drawing wherein:

FIG. 7 is a fragmentary plan view of a throttle lever arrangement used in the tool of the invention;

FIG. 8 is a cross section view as seen from line 8—8 in FIG. 7.

Figure 1:
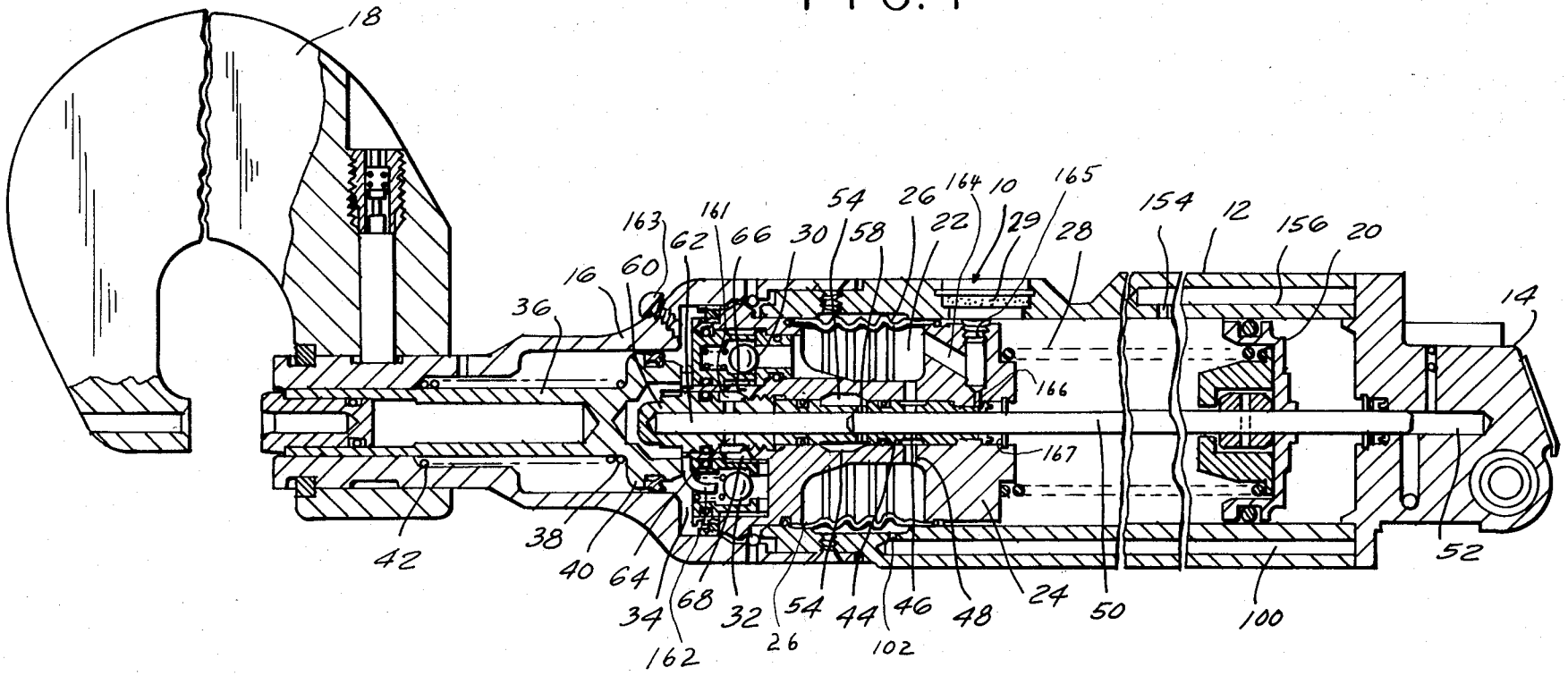
FIG. 1 is a longitudinal fragmented section view of a tool embodying the principles of the invention.

Referring now to the drawings, FIG. 1 identifies a pneumatic hydraulic hand-held riveting tool incorporating the principles of the invention, which tool includes a main cylindrical housing 12 having a backhead or rear cover 14, secured at one end, and a hydraulic cylinder 16 secured at the opposite end. A work engaging means, such as a "C" type riveting yoke 18 is removably secured to a forward portion of the hydraulic cylinder 16. Rivet die sets are not illustrated in the yoke, since these sets can be of various size and shape. The cylindrical housing 12 encloses a pneumatic portion in which a piston 20 is slidingly arranged, and a hydraulic portion in which is located a hydraulic reservoir 22, formed within the confines of a reservoir element 24. The peripheral region of the reservoir has a bladder 26 secured at each end of the reservoir element 24. The bladder can be made from an elastomer such as Buna type N. Hydraulic pressurizing means other than a bladder may be utilized as will readily be apparent to those skilled in the art.

A helical spring 28 is compressively arranged between the piston 20 and one end of the reservoir element 24. A filtered opening 29 is provided for venting the cylindrical portion enclosing the spring 28.

The reservoir element 24 encloses a bushing 44 and tube element 60 which form an axial passageway 62 that slidingly accommodates ram 50. The reservoir element 24 also contains a filler plug 165 and has a scavanger port 166.

Figure 2:
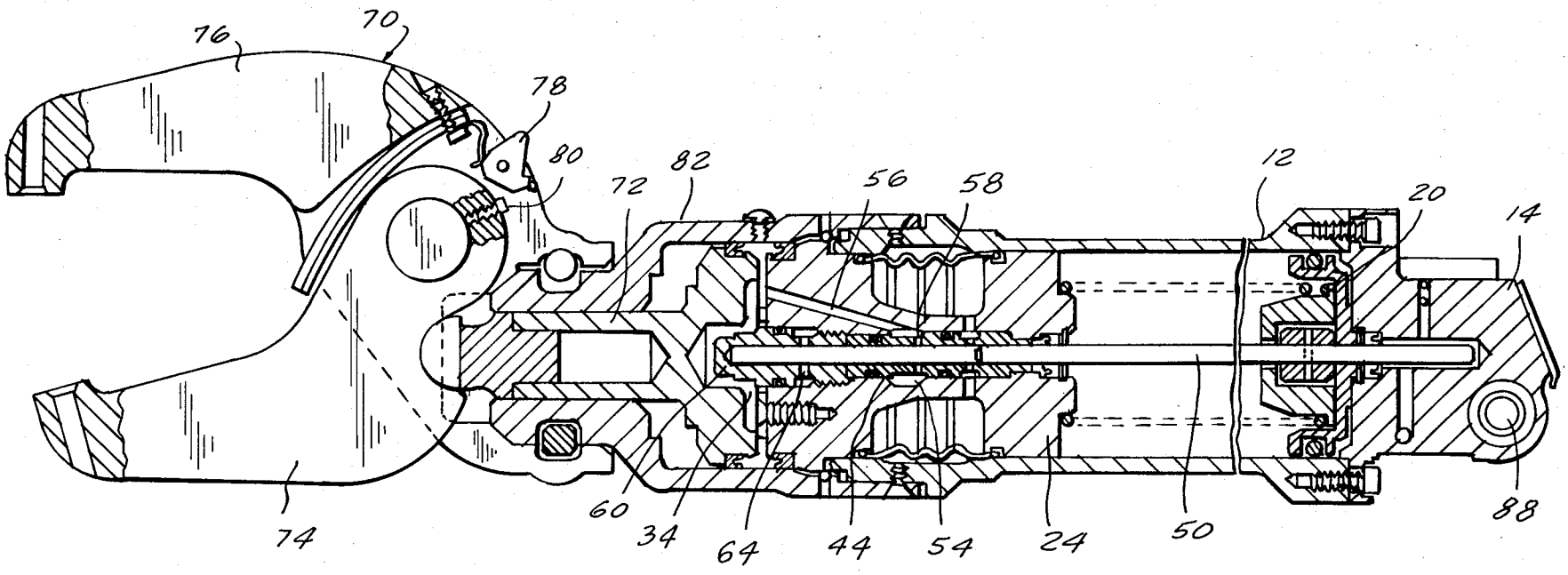
FIG. 2 is a longitudinal section view of a tool like that of FIG. 1, but showing a cross section taken at a different angle than that of the cross section of FIG. 1, and with an alligator riveting yoke being used instead of the "C" clamp yoke of the tool of FIG. 1.

Bushing 44 has radial holes 46 which, thru holes 48, connect chamber 62 with reservoir 22. Bushing 44 also has radial holes 58 which connect chamber 62 to cylindrical chamber 54. As best seen in FIG. 2, cylindrical cavity 54 has at least one passageway 56 interconnecting the cavity with chamber 34.

As seen in FIG. 1, tube 60 has radial holes 64 connecting chamber 62 with groove 161. An angular hole 66 connects groove 161 with the outlet of check valve 30, while an angular hole 68 connectes groove 161 with the inlet of check valve 32. The outlet of check valve 32 is connected to the chamber 34 by a hole 162.

The hydraulic cylinder 16 encloses a piston 36, and has a bleeder screw 163. A helical spring 38 is compressively arranged between a head 40 of piston 36 and a circular abutment 42 formed on an inner portion of the cylinder 16.

The tool of FIG. 2 differs from that of FIG. 1, primarily because an alligator yoke 70 is utilized in place of the "C" clamp yoke 18. A piston 72, which is shorter than the piston 36 of the FIG. 1 tool, is arranged to act against a jaw 74 pivotally affixed to a complementary jaw 76 of the alligator yoke 70. A latch, or pawl mechanism 78, is provided to limit opening movement of the yoke, one portion of the latch being arranged for abutment with a pin 80 on the jaw 74 when limited jaw opening is desired. The jaw 76 is pivotally secured to a hydraulic cylinder 82 which encloses a piston 72.

Within the backhead 14 is a throttle valve 84, a cycling valve 86 and a self-relieving pressure regulating valve 88 all as best seen in FIGS. 3 to 6. The throttle valve 84 has a head 90, which is urged into seating engagement with a bushing 94 by a compression spring 92, the bushing 94, having radial openings 96. The openings are in alignment with the ends of passageway means 98, leading to the cycling valve 86 and a pre-fill passageway 100 (FIG. 1 and FIG. 9) the forward end of which connects with an opening 102 for admission of pressurized air to the exterior of bladder 26.

Figure 3:
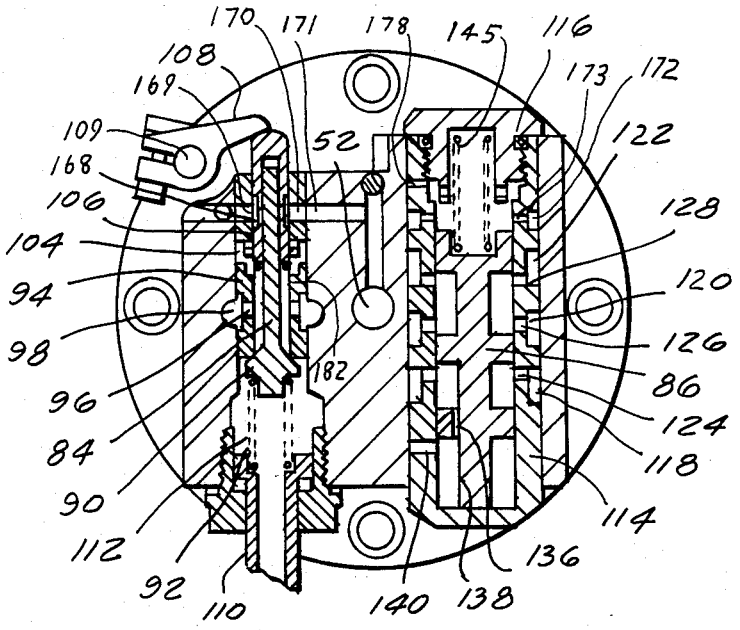
FIG. 3 is a cross section view of certain portions of the tool backhead and showing the throttle valve and air flow control cycling valve in tool shut-off, or non-operative position.
Figure 4:
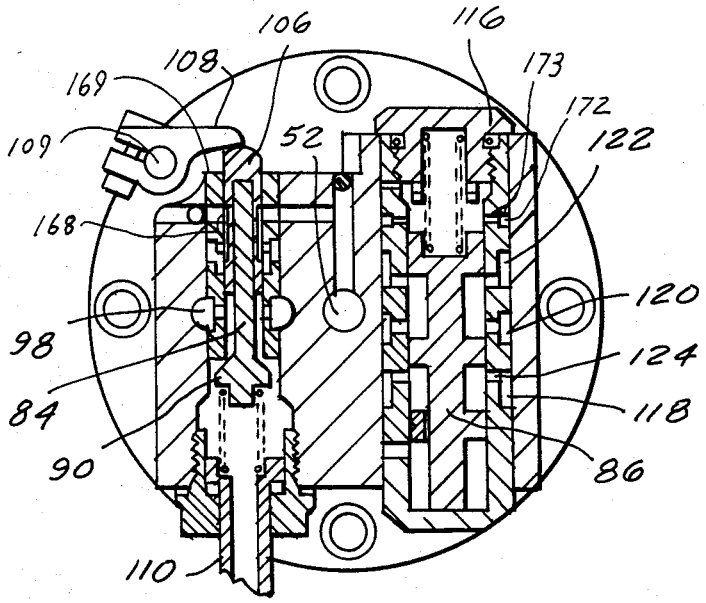
FIG. 4 is the same as FIG. 3 but showing said valves in pre-fill position.

The region 104 (FIG. 3) above the upper end of bushing 94 leads to exhaust. A throttle valve sleeve 106, affixed to the upper end of the throttle valve 84, is engageable by a throttle lever 108 whereby the valve may be unseated from the bushing 94. The throttle lever 108 is affixed to one end of a rod 109, the other end of the rod having a throttle control handle 111. The rod 109 is axially movable and spring biased toward non-operative position (FIG. 7). The operator must shift the control handle 111 over an abutment 113 on the housing 12 before it can be rotated to provide throttle opening condition. A swivel hose connection 110 is arranged for admission of pressurized air into chamber 112 in which the throttle head 90 is located. Throttle valve sleeve 106 has an exterior circumferential groove 168 and is slidingly accommodated in bushing 169 (FIGS. 3 and 4).

Bushing 169 has a hole 170 which connects with passageway 171.

Figure 5:
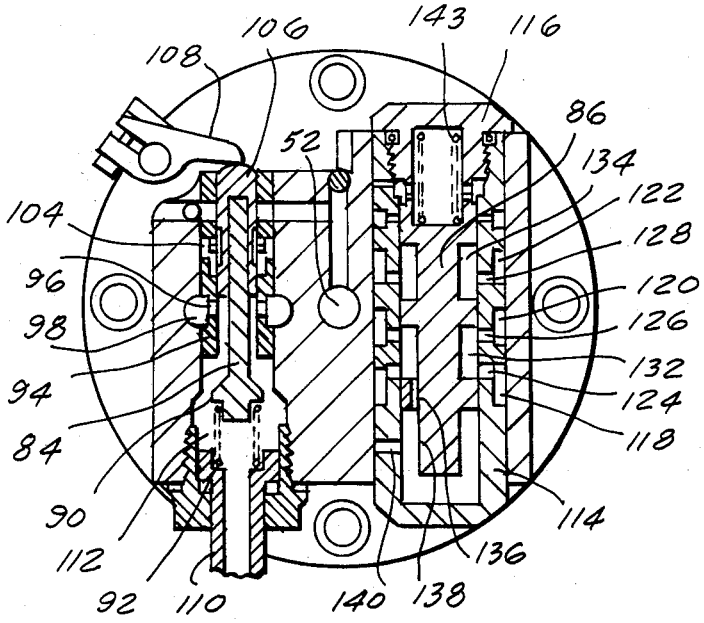
FIG. 5 is the same as FIG. 3, but showing said valves in cycling position.
Figure 6:
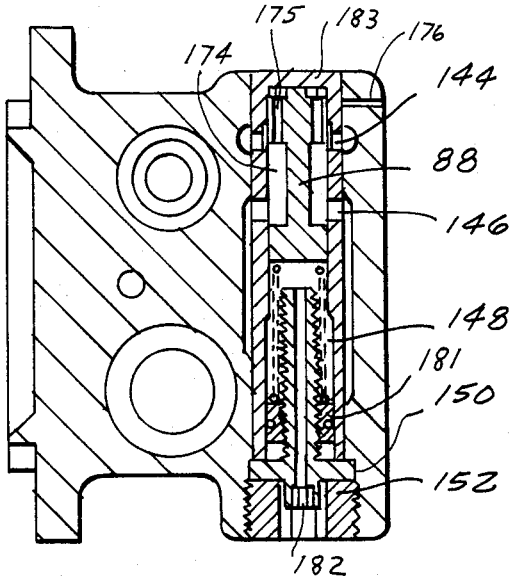
FIG. 6 is a cross-section view through a self relieving pressure regulator positioned in the tool backhead.
Figure 9:
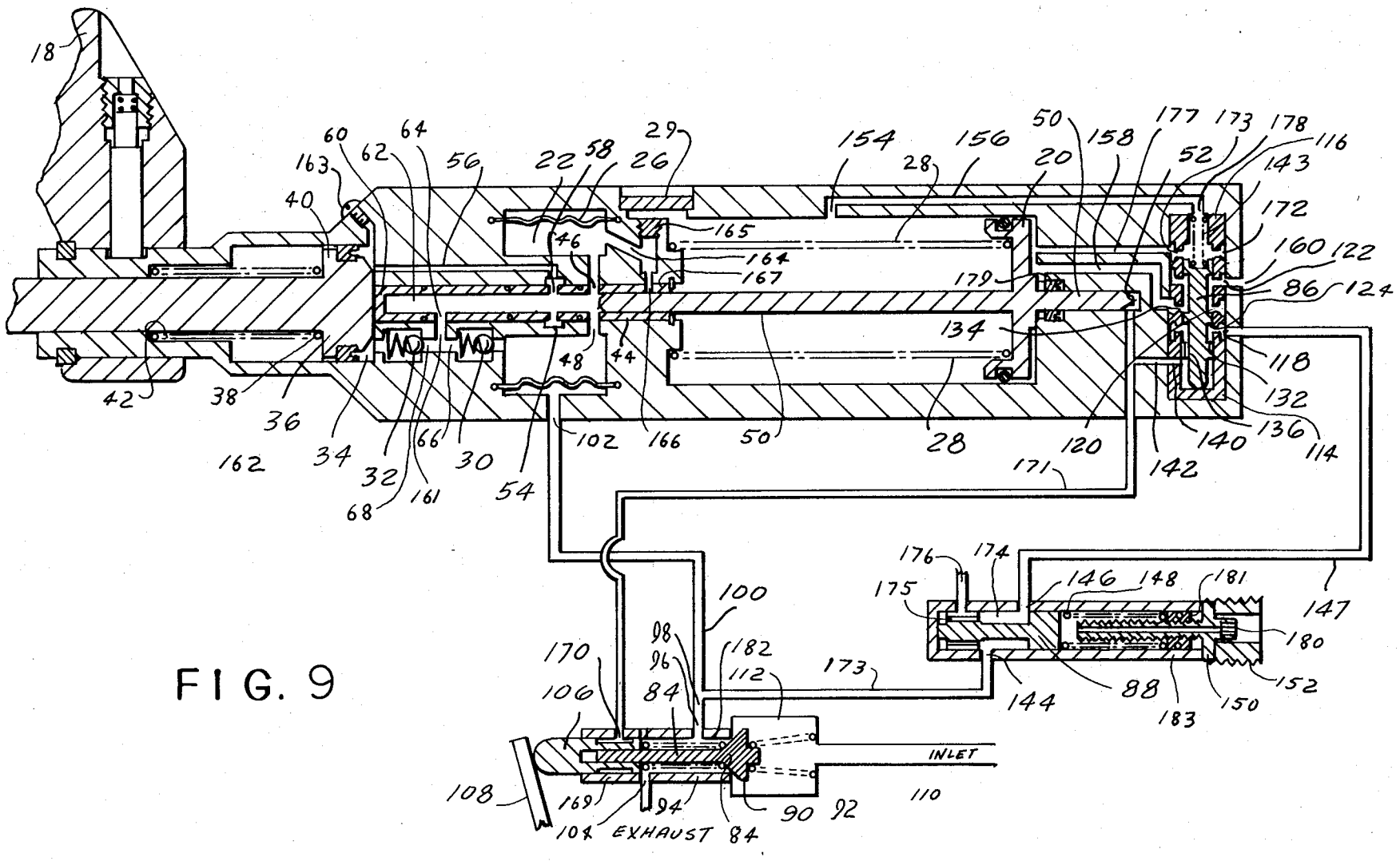
FIG. 9 is a schamatic view of the tool of FIG. 1 showing the operative parts in tool rest, or release condition.

The cycling valve 86 is slidably arranged in a bushing 114, the lower end being permanently closed, the upper end being closed by an end cap 116 threadably affixed to the bushing 114. The bushing has exterior circumferential grooves 118, 120, 122 and 172 each being connected to the interior of the bushing by radial holes 124, 126, 128 and 173, respectively (FIGS. 3–5). A radial hole 140 in the bushing 114 leads to a passageway 142 (FIG. 9) which connects to passageway 171. Another hole 178 connects with passageway 156 which leads to signal port 154 (FIG. 9). The cycling valve 86 has circumferential grooves 132 and 134. Groove 132 has a passageway 136 which opens into the lower region of the bushing 114 beneath the end of the cycling valve 86, (FIG. 5). A compression spring 143 is arranged to urge the valve 86 toward the lower end of bushing 114.

As seen in FIG. 9, groove 118 on cycling valve bushing 114 is connected to live air from passageway 147. Groove 120 connects to passageway 158 which leads to the cylinder housing in back of piston 20. Groove 122 opens to exhaust 160. Groove 172 is connected to passageway 177 which leads to the cylinder housing behind piston 20.

The pressure regulating valve 88 has a circumferential groove 174 and several passages 175 through the valve upper head. The valve has a normal position where, under the load of adjustable spring 148 on the lower head, the valve 88 is held against the closed end of bushing 183. Bushing 183 has radial holes 146 leading to passageway 147, radial holes 144 leading to passageway 173 and vent holes 176 and 180 connected to exhaust.

The spring pressure adjusting screw 150 is locked in position by a nut 152. A pressure regulating valve of the type described is similar in structure and operation to that disclosed in the patent of Wallace at al U.S. Pat. No. 3,951,217, with the exception of vent hole 176; the disclosure of U.S. Pat. No. 3,951,217 is incorporated in its entirety herein.

OPERATION

The operation of the tool of the invention is depicted in the schematic drawings of FIGS. 9 thru 14. FIG. 3 and FIG. 9 show the operative parts of the tool in the non-operative condition, with the throttle valve 84 closed or seated, and the cycling valve 86 in the down position. In such condition the cylinder area in back of piston 20 is connected to exhaust via passageway 158, into groove 120, thru bushing holes 126, into valve groove 134, out bushing holes 128 and into groove 122 which is connected to the exhaust 160. The piston 20 is fully retracted because of spring 28.

Figure 10:
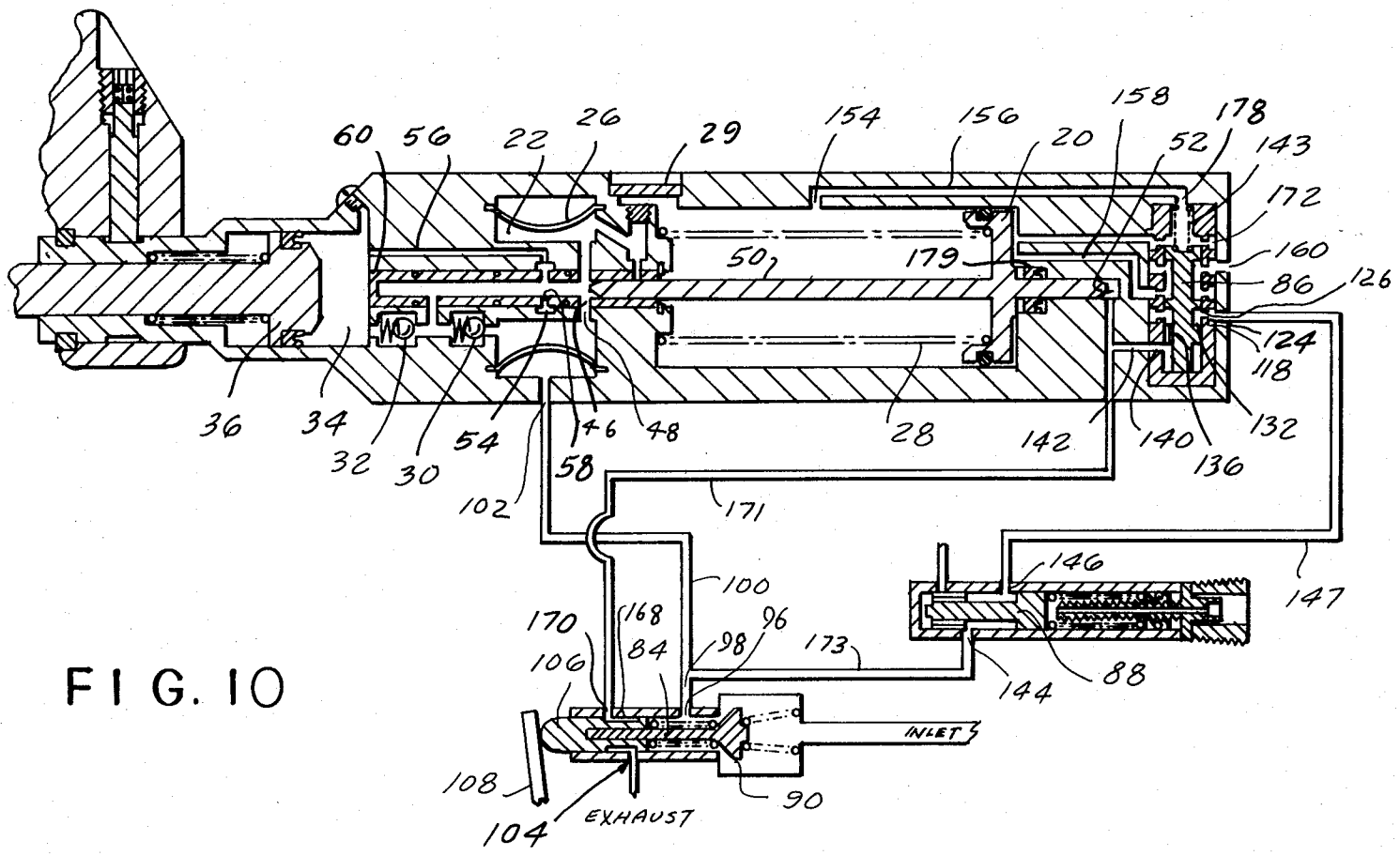
FIG. 10 is a schematic view of the tool of FIG. 1 showng the operative parts in tool pre-fill condition.

FIGS. 4 and 10 show the operative parts of the tool in the pre-fill condition, caused by a slight opening of the throttle valve. A small amount of air is admitted to passageway 98, which connects to passageways 100 and 173. Air in passageway 173 enters pressure regulating valve 88 thru port 144, out thru port 146, into passageway 147. The air enters groove 118 on cycling valve bushing 114, thru port 124, into groove 132 on cycling valve 86, then flows thru passageway 136 into the region below cycling valve 86. The air then continues to flow thru port 140, passgeway 142, to passageway 171. One end of passageway 171 is blocked by piston rod 50 in passageway 52; the other end of passageway 171 connects with port 170 in throttle valve bushing 169 (FIG. 3 and FIG. 9). The air enters the bushing thru port 170, into groove 168, on valve sleeve 106. As shown in FIG. 4 and FIG. 10, groove 168 connects port 170 with exhaust chamber 104. Due to the air in passageway 171 thus being connected to exhaust, pressure cannot build up on the lower end of cycling valve 86 and the tool cannot cycle, i.e. develop rivet setting pressure. The air in passage 100 enters the reservoir chamber thru port 102 and pressurizes the volume outside of bladder 26.

When the volume outside the bladder is pressurized, oil is forced out of reservoir 22. The oil goes thru port 46 and 48 into the space ahead of ram 50 in bushing 44 and tube 60, out port 58, into chamber 54 and thru passageway 56, into piston chamber 34, causing piston 36 to advance and contact the work. Additional oil may also flow from the reservoir 22, thru check valves 30 and 32, into piston chamber 34.

Figure 11:
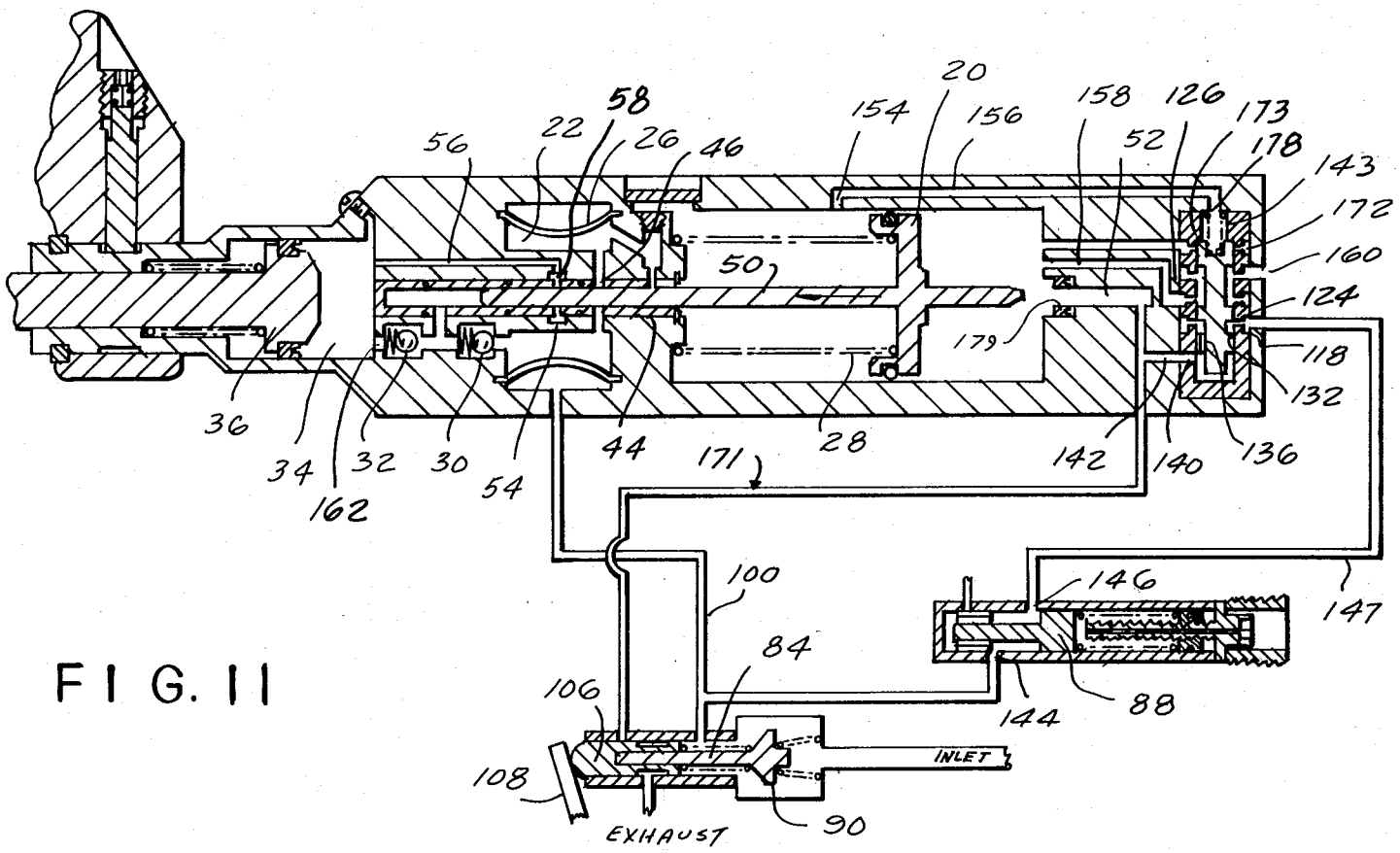
FIG. 11 is a schematic view of the tool of FIG. 1, showing the operative parts in tool power stroke condition.

FIG. 5 and FIG. 11 show the operative parts of the tool during a power stroke. The throttle valve 84 is fully depressed, which allows air flow to continue in prefill passageway 100, but air flow through passageway 171 to exhaust is blocked by throttle valve sleeve 106.

At the start of the power stroke, the piston 20 and rod 50 are fully retracted, as shown on FIG. 10 and the throttle valve is wide open, as shown on FIG. 11. With passageway 171 blocked (FIG. 11) and piston rod 50 entered in packing 179 (FIG. 10), chamber 52 is sealed off so that air flow through passageway 136 can build up pressure under cycling valve 86. The top of cycling valve 86 is vented thru port 178, passageway 156, port 154 to the cylinder ahead of piston 20, which is vented thru filter 29. Thus, the pressure build up on the bottom of cycling valve 86 overcomes spring 143 and the valve shifts to the up position. With valve 86 in the up position (FIG. 11), air in groove 118 enters thru bushing holes 124 into cycling valve groove 132, out bushing holes 126, into groove 120, thru passageway 158 to the cylinder housing in back of piston 20. Hole 173 is blocked by valve 86. The piston 20 moves forward due to the pressure behind it. The forward end of ram 50 crosses port 46 and then port 58 in bushing 44, thus blocking them off. Pressure builds ahead of ram 50, forcing the hydraulic medium thru check valve 32, out port 162, into chamber 34.

Figure 12:
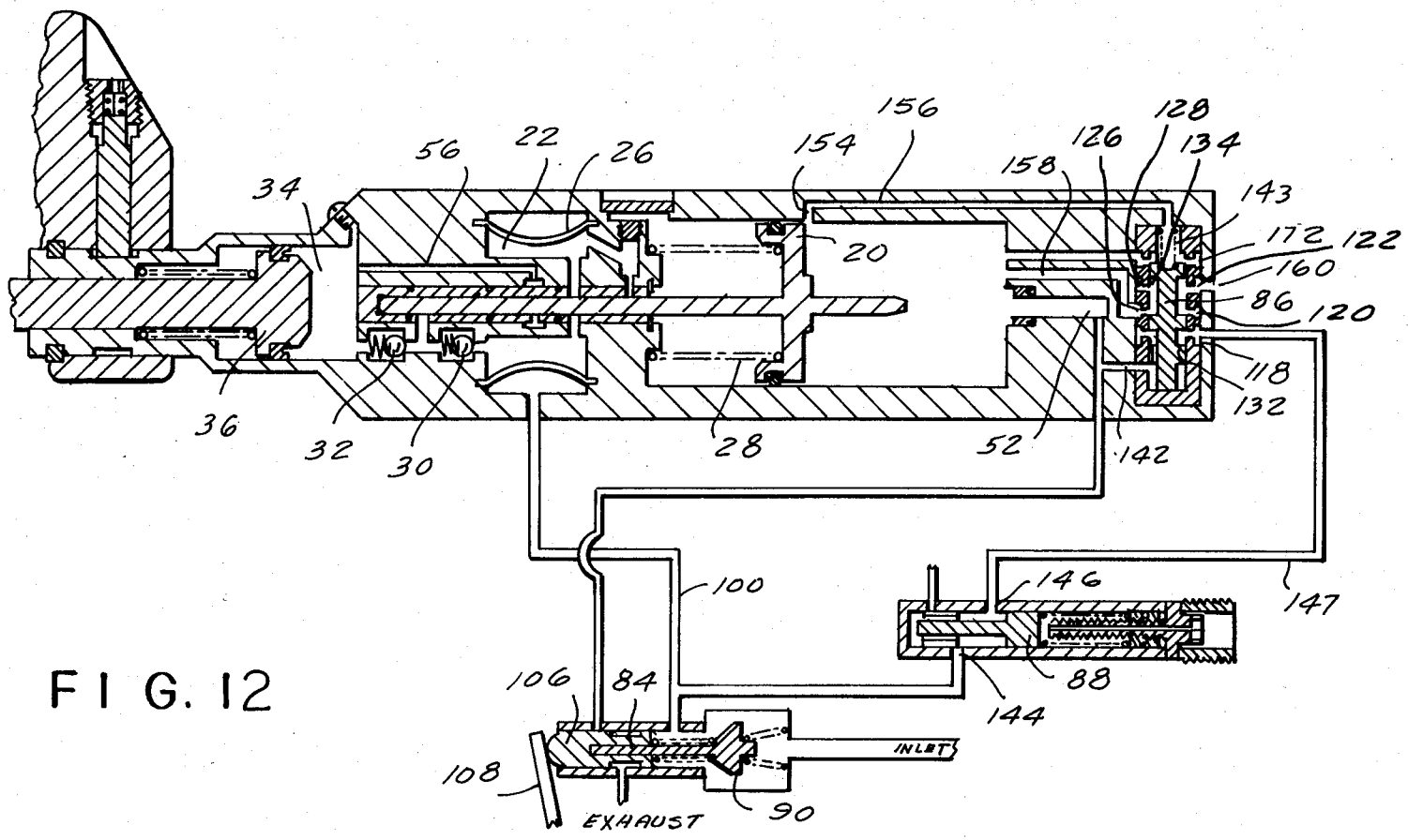
FIG. 12 is a schematic view of the tool of FIG. 1 showing the operative parts of the tool at end of the power stroke.
Figure 13:
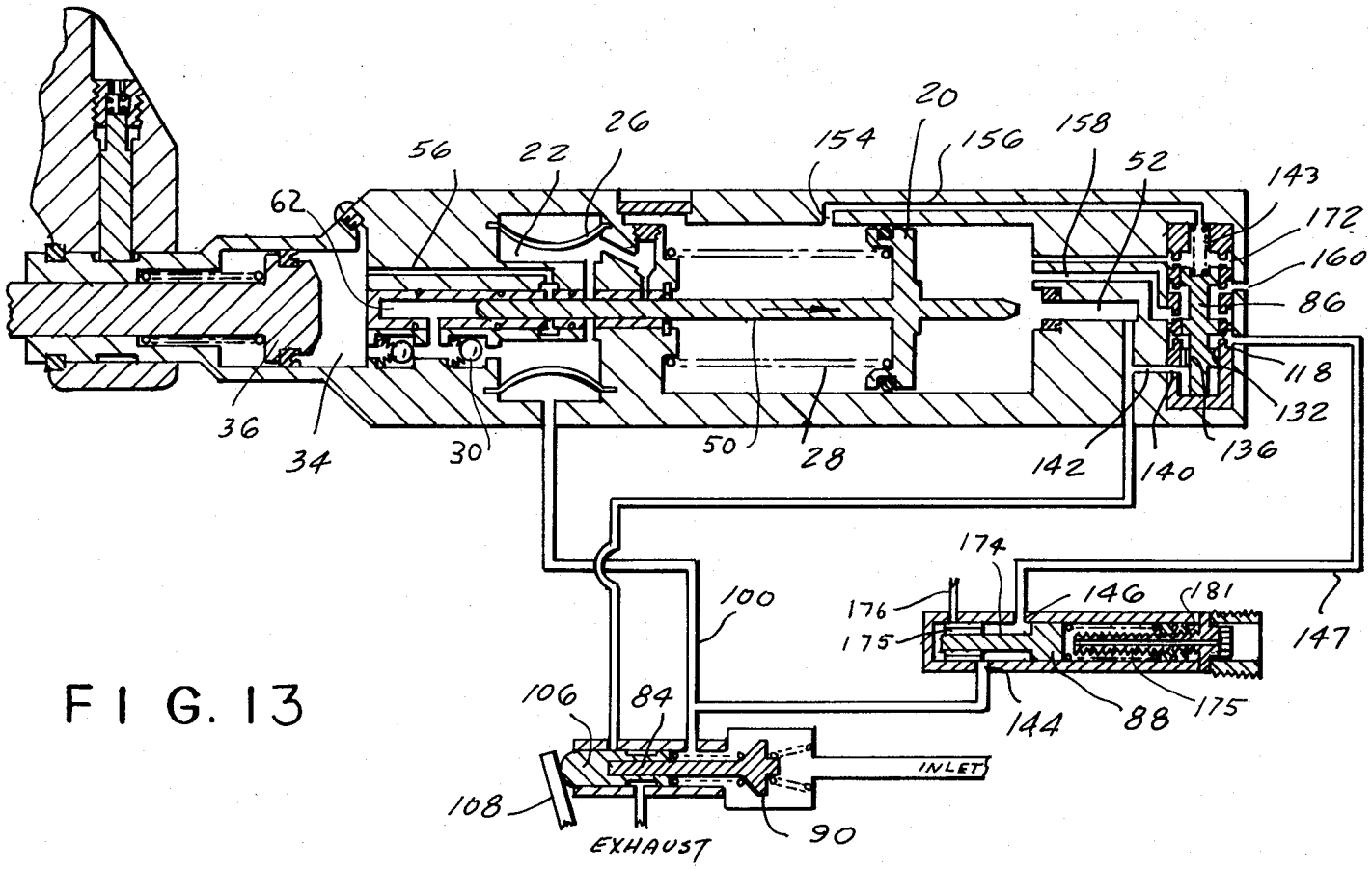
FIG. 13 is a schematic view of the tool of FIG. 1, showing the operative parts of the tool during return stroke of a pneumatic piston of the tool.

The ram 50 will continue to move forward until either the hydraulic pressure ahead of ram 50 times the ram area equals the air pressure behind piston 20 times the piston area causing the piston 20 to stop or "stall", or the piston 20 will go beyond port 154 (FIG. 12). When piston 20 passes port 154, air pressure behind piston 20 enters port 154, goes through passageway 156, thru port 178, and pressurizes the top of valve 86. This equalizes the pressure on both ends of valve 86, allowing spring 143 to return the valve to its normal (down) position.

With valve in the down position, the air behind piston 20 is connected to exhaust through passageway 158, groove 120, holes 126, groove 134, holes 128, into groove 122, and out exhaust 160. When the pressure behind piston 20 goes to exhaust, spring 28 is able to return piston 20 and ram 50.

Figure 14:
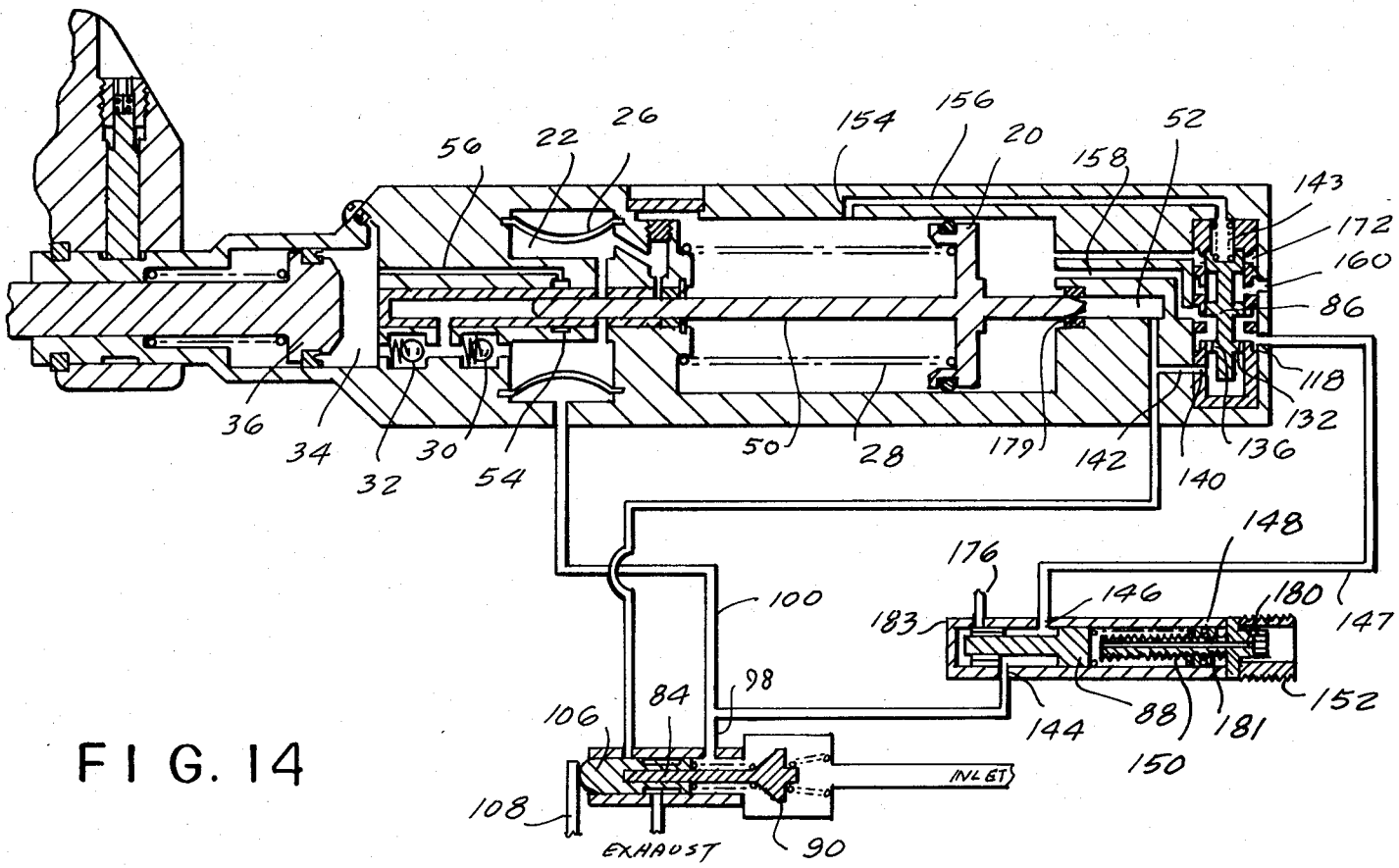
FIG. 14 is a schematic view of the tool of FIG. 1, showing the operative parts of the tool at end of return stroke of the penumatic piston of the tool.

As ram 50 returns, the hydraulic pressure ahead of it drops and additional fluid from reservoir 22 is forced (due to air pressure on bladder 26) through check valve 30 into volume ahead of ram 50. Piston 20 continues to return until the extension of ram 50 behind piston 20 enters packing 179 (FIG. 14). This seals off chamber 52 and allows air pressure to build up under valve 86, hereinbefore described and the valve shifts up, causing the piston 20 to start forward again. This cycling will continue until the tool "stalls" or the throttle is released.

As shown on FIG. 14, the shift point for valve 86 occurs when the ram 50 enters packing 179. Therefore, ram 50 never uncovers ports 58 or 46 during normal cycling and the unit cycles until the output pressure that "stalls" the tool is reached.

When the throttle control handle 111 is released, throttle valve 84 returns to seating engagement on bushing 94, shutting off air to the tool. As seen in FIG. 3, spring 182 moves valve sleeve 106 up connecting cavity 98, thru holes 96 into bushing 94, and then to exhaust 104. The air pressure under cycling valve 86 is exhausted, and valve 86 shifts down exhausting all remaining air behind piston 20.

The piston 20 and ram 50 are retracted because of spring 28 (FIG. 9). Spring 42 moves cylinder 36 back, forcing the oil from chamber 34, through passageway 56 to groove 54, through holes 46 into bushing 44, and out of holes 48 into reservoir 22.

The pressure regulator (FIGS. 6 and 9 thru 14) contains an adjustable spring 148, which urges valve 88 toward the closed end of bushing 183. Spring adjusting screw 150 has a vent hole 180 through it. Adjustment is made by loosening nut 152 and turning screw 150, thus causes nut 181 to move up or down the screw, changing the spring load. Nut 152 is tightened to lock screw 150 in position.

Air is admitted to the necked down portion of valve 88 through holes 144. The valve has holes 175 through its upper head, which cause the valve to be pneumatically unbalanced and move toward compressing spring 148, thereby restricting the inlet ports 144. The resulting restricted supply flow through inlet port 144 reduces the pressure inside the bushing until the pressure acting on the regulator valve is equal to the spring force. Consequently, the pressure of the air passing through the outlet ports 146 to the tool will be reduced.

In the event that the pressure to the tool should exceed the spring setting (due to leakage into the stalled tool), the valve would compress the spring enough to open vent 176 and bleed off the excess pressure.

To fill the tool with hydraulic fluid the filter element 29 is removed providing access to plug 165, (FIG. 1).

Plug 165 and bleeder screw 163 are removed and hydraulic fluid is added thru plug 165 into passageway 164, which leads to reservoir 22. As shown in FIG. 9, hydraulic fluid in reservoir 22 enters bushing 44 through hole 48, out thru hole 46, into passageway 56 to 34 behind the piston. Air in the system is allowed to escape out bleeder port 163. When the reservoir is full, bleeder screw 163, plug 165, and filter element 29 are replaced.

Any hydraulic fluid that might leak past ram 50 and bushing 44 cannot pass packing 167 and is returned to the reservoir thru scavanger port 166.

We claim:

1. A pneumatic hydraulic tool having a cylindrical housing, a backhead affixed at one end of the cylindrical housing, a hydraulic cylinder affixed to the other end of the cylindrical housing, a work engaging means secured to the hydraulic cylinder, a reservoir element enclosed in the cylindrical housing, a flexible bladder arranged in the reservoir element which bladder encloses hydraulic medium and may be exposed to pressurized pneumatic medium on the exterior thereof, a piston enclosed in the hydraulic cylinder which piston may be hydraulically driven toward the work engaging means, a piston driven ram in the cylindrical housing, said backhead enclosing a throttle valve and a cycling valve, said throttle valve being movable from non-operative position to two operative positions the first of which results in exposure of the bladder to pressurized air to force hydraulic medium from the reservoir element to cause movement of the piston toward the work engaging means, the second of which results in operation of the cycling valve to direct pressurized pneumatic medium to the cylindrical housing to cause movement of the piston driven ram whereby pressurized hydraulic medium is directed to the piston in the hydraulic cylinder so that a work operation is effected.

2. A pneumatic hydraulic tool according to claim 1, wherein a self-relieving pressure regulating valve is arranged in the backhead whereby pressurized pneumatic medium to the tool may be controlled to produce work operating pressure needed for a work operation.

3. A pneumatic hydraulic tool according to claim 1, wherein said cycling valve will cause repeated reciprocal movement of the ram until the hydraulic pressure developed by ram movement is equal to work resistance resulting in stall condition of the tool.

4. A pneumatic hydraulic tool according to claim 1, wherein means are provided so that mmovement of the throttle valve to non-operative position results in movement of the piston in the hydraulic cylinder away from the work engaging means.

5. A pneumatic hydraulic tool according to claim 1, including a throttle lever arranged for operative movement of the throttle valve, and an abutment means for the throttle lever which restricts initiation of throttle valve movement until the throttle lever is moved clear of the abutment means.

6. A pneumatic hydraulic tool according to claim 1, wherein a resilient means is arranged between the reservoir element and the piston driven ram to move the piston driven ram toward the backhead.

7. A pneumatic hydraulic tool according to claim 1, wherein a resilient means is arranged at one end of the cycling valve to move the cycling valve to non-cycling position when air pressure on each end of the valve is equalized.

* * * * *